US006076893A

United States Patent [19]

Brotherston

[11] Patent Number: 6,076,893

[45] Date of Patent: Jun. 20, 2000

[54] FLIPDOWN FOOTREST INVENTION

[75] Inventor: Ian Brotherston, Listowel, Canada

[73] Assignee: Broda Enterprises Inc., Waterloo, Canada

[21] Appl. No.: 09/073,690

[22] Filed: May 6, 1998

[51] Int. Cl.[7] ..... A47C 7/50

[52] U.S. Cl. ..... 297/423.35; 297/423.25

[58] Field of Search ..... 297/423.3, 423.35, 297/423.26, 423.25

[56] References Cited

U.S. PATENT DOCUMENTS

| | | | |
|---|---|---|---|
| 2,935,123 | 5/1960 | Lloyd-Young | 297/423.3 X |
| 3,215,469 | 11/1965 | Wamsley | 297/423.3 X |
| 3,990,744 | 11/1976 | Rodaway . | |
| 4,033,624 | 7/1977 | Jun | 297/423.3 |
| 4,120,532 | 10/1978 | Clanan . | |
| 4,155,126 | 5/1979 | Classen | 297/423.3 X |
| 4,538,857 | 9/1985 | Engman . | |
| 5,039,167 | 8/1991 | Sweet | 297/423.35 X |
| 5,056,864 | 10/1991 | Cooper | 297/423.3 X |
| 5,505,519 | 4/1996 | Natt | 297/423.26 X |
| 5,522,644 | 6/1996 | Peek | 297/423.35 X |

FOREIGN PATENT DOCUMENTS 2170959 9/1997 Canada .

*Primary Examiner*—Peter M. Cuomo
*Assistant Examiner*—Stephen Vu
*Attorney, Agent, or Firm*—Killworth, Gottman, Hagan & Schaeff, L.L.P.

[57] ABSTRACT

A footrest is provided herein for use with health care chairs fur invalids and patients. The footrest includes two footplate members independently pivotally coupled to the leg rest or the frame of a health care chair such that each footplate member is capable of being swung upwardly and downwardly, independent of the other footplate member to facilitate access to the health care chair. Stop means are further provided for positioning one or both footplate members at a fixed position of tilt relative to the leg rest and/or the chair frame, and thereby increasing the general comfort of the occupant of the health care chair.

8 Claims, 6 Drawing Sheets

FLIPDOWN FOOTREST INVENTION

FIELD OF INVENTION

The present invention relates to the field of health care chairs and chair accessories and, more particularly, it relates to footrests for use with health care chairs.

BACKGROUND OF THE INVENTION

Due to significant medical advances, the average human lifespan has been considerably extended. Consequently, there is a growing population of elderly people in our society today. The elderly, on average, spend more daytime hours sitting than younger people and often for extended periods of time. As well, a significant portion of the aging elderly are ultimately Institutionalized wherein residents of health care institutions, for a variety of health reasons, spend a large portion of their waking hours sitting.

Because of increasing numbers of people who are sitting for long and uninterrupted periods of time, there is a need to provide chairs which comfortably accommodate these people. Further, people may have peculiar sitting positions which are comfortable to them. Consequently, there is a need for chairs which accommodate a variety of sitting positions.

Current chair designs contain footrests to support the sitter's legs and feet. These footrests are generally comprised of two members, a log rest and a footplate. The leg rest is coupled to the chair seat and extends downwards below the chair seat for supporting both the sitters lower legs. Both of the sitter's feet are supported by a footplate coupled to the lower end of the leg support frame. To facilitate ease of access to the chair, coupling of the footplate to the leg rest is pivotable. By virtue of this pivotable coupling, the footplate can be swung upwards and out of the way of a person attempting to access the chair for sitting purposes. Once a person is seated in the chair, the foot plate may be swung back to its original position to support the sitter's feet. However, in order to flip the toot plate back to its original position, the siting single foot plate. This causes discomfort to the person sitting in the chair, increases work for the caregiver, and poses a safety hazard to the caregiver. Accordingly, there is a need for a foot rest which eliminates the necessity of lifting the sitter's feet when flipping down a single foot plate.

Footrests are also provided which are dedicated for supporting a single leg of a person sitting in a health care chair. In this respect, the leg rest and foot plate combination are adapted for supporting one leg and one foot respectively. Accordingly, to support both the sitter's legs, two such leg rest and foot plate combinations are required. Such designs, although addressing the above-described chair access problem, are not suitable for certain kinds of patients because of the fact that a region of free space exists between the leg rests. In particular, such designs are dangerous for patients who are unable to keep their legs stationary, such as those experiencing Huntington's disease or dementia, because of the possibility that their legs may become lodged within the space between the two leg rests.

It is also desirable to provide a footrest, adapted for use with a chair, including a footplate which is capable of assuming various fixed positions of tilt. People with certain medical conditions feel discomfort if required to maintain a sitting position wherein the soles of their feet rest in a plane which is substantially parallel with their buttocks. Footrests which fail to accommodate various orientations of a peron's feet when supporting these feet only contribute to discomfort and aggravate such person's general well being.

SUMMARY OF INVENTION

The present invention discloses a footrest, for use in association with chairs, which permits a user of the chair to change the angle from the horizontal at which his or her feet are supported. Further, the present invention also discloses a footrest consisting of two separate and independent foot plates depending from a common leg support frame.

In its broad aspect, the health care chair for invalids and patients of the present invention, includes a supporting chair frame, and a foot rest, said footrest comprising: two footplate members wherein each of said footplate members is independently pivotally coupled to said frame for pivotal movement from a substantially horizontal position to a substantially vertical position; and adjustable stop means for positioning said footplate members at a fixed position of tilt relative to said frame. More particularly, said footplate members are pivotally coupled to said chair frame along a common horizontal axis and extend forwardly and rearwardly of said axis, said adjustable stop means are extendible stop members received by said chair frame, and the lower ends of said stop members are disposed rearwardly of said common axis and adapted for biasing against the rear of said footplate members. Preferably, said adjustable support means is a substantially vertical threaded member received by said leg support member in a mating threaded aperture for adjustable vertical travel.

The footrest comprises a substantially vertical leg support member having an upper proximal end and a lower distal end; two footplate members; said leg support member removably coupled to said frame at the upper proximal end thereof; and said footplate members independently pivotally coupled to said leg support member at the lower distal end thereof; and adjustable stop means for positioning said footplate members at a fixed position of tilt relative to said leg support member.

BRIEF DESCRIPTION OF DRAWINGS

The invention will be better understood and objects other than those set forth above will become apparent when consideration is given to the following detailed description thereof. Such description makes reference to the annexed drawings wherein.

DESCRIPTION OF PREFERRED EMBODIMENT

Figure 1:
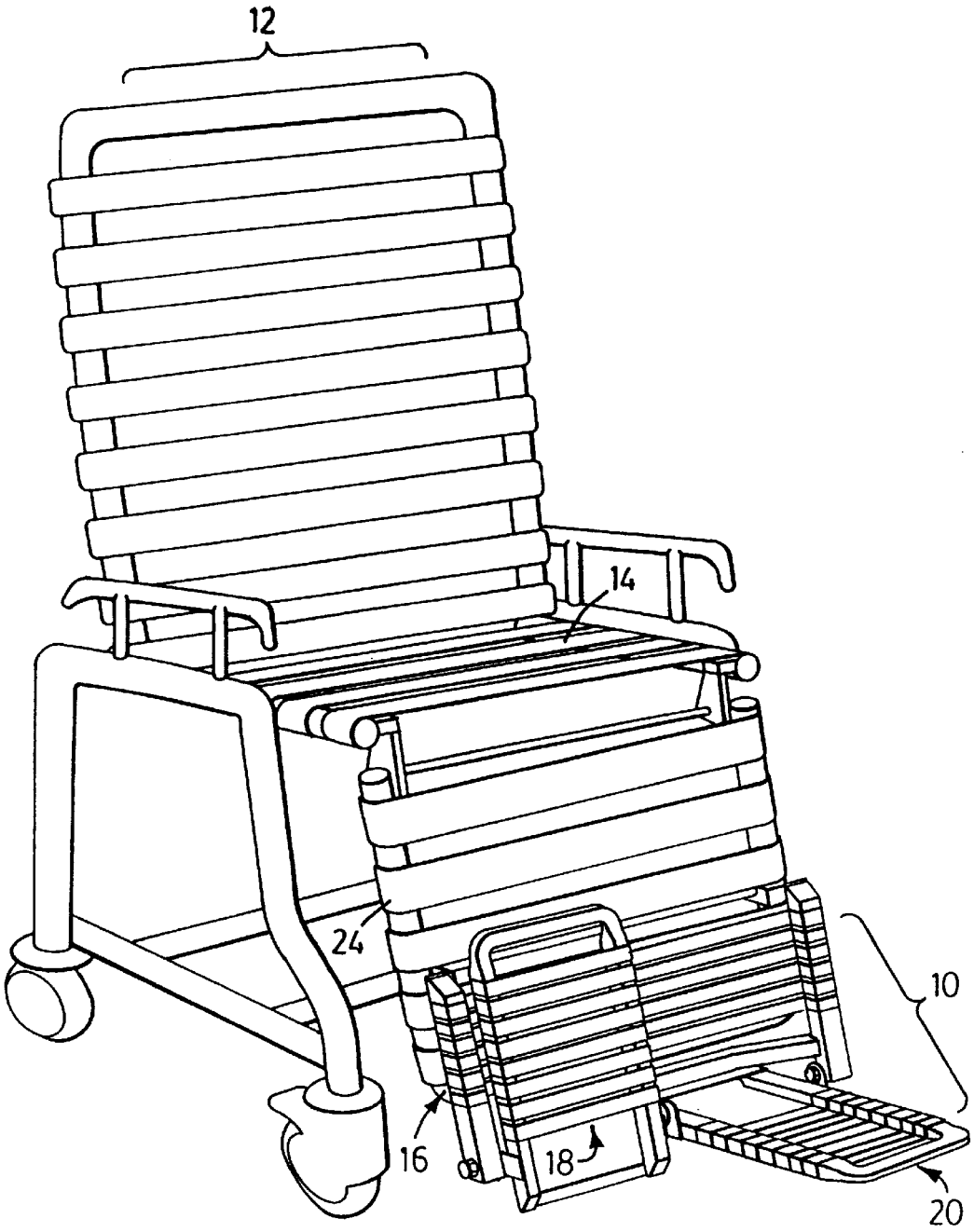
FIG. 1 is a top perspective view of the health care chair of the present invention, including the footrest.
Figure 3:
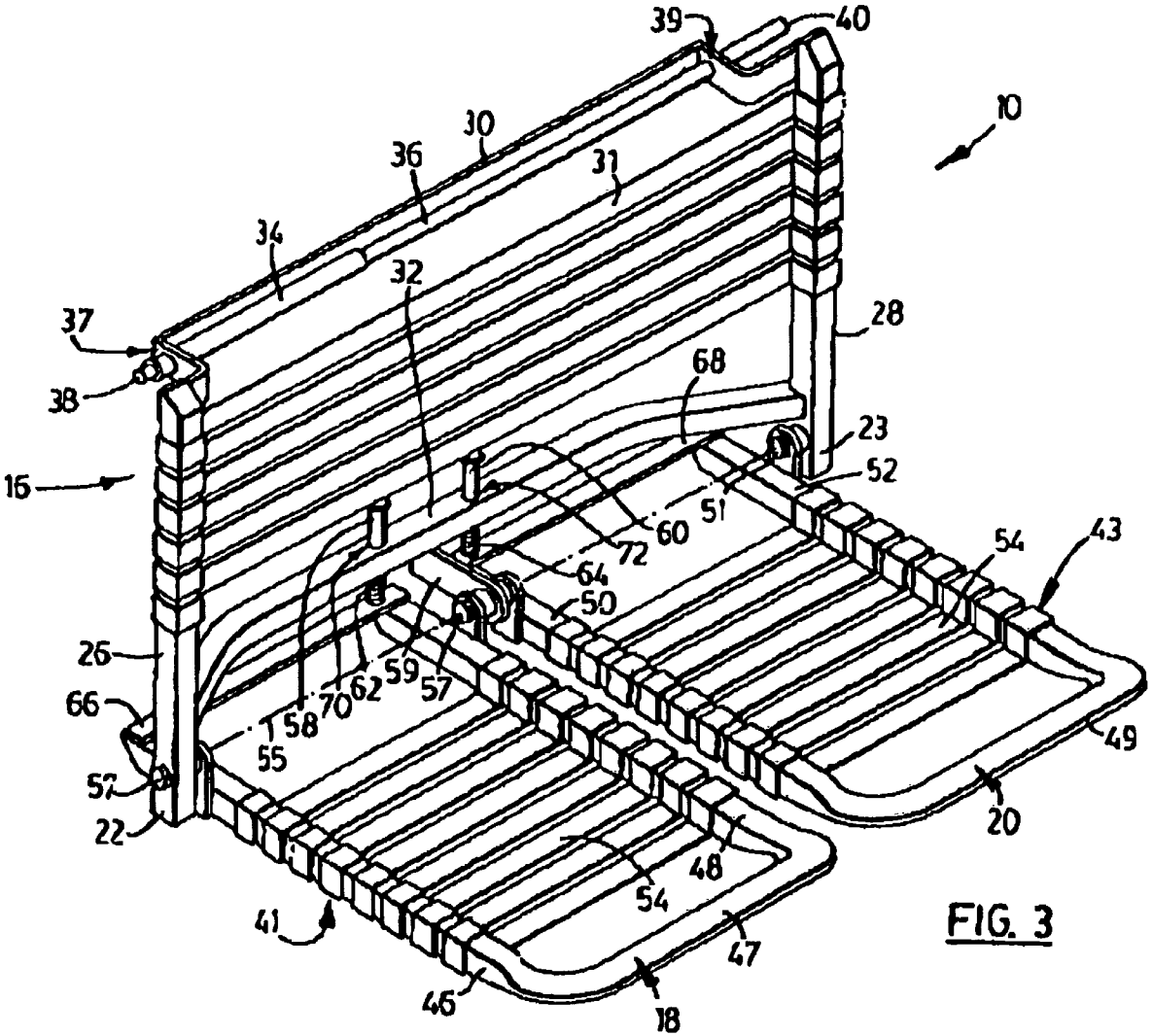
FIG. 3 is a top perspective view of the footrest of the present invention.
Figure 4:
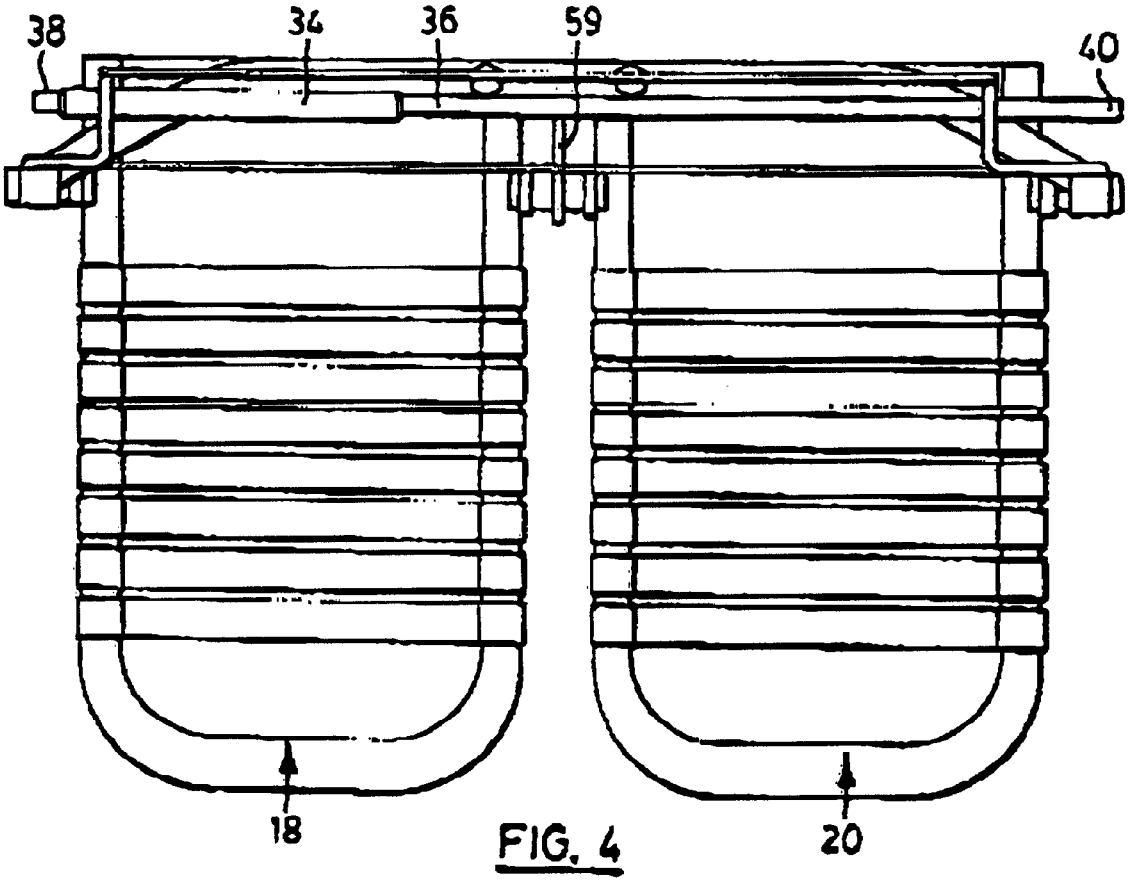
FIG. 4 is a top plan view of the footrest.
Figure 5:
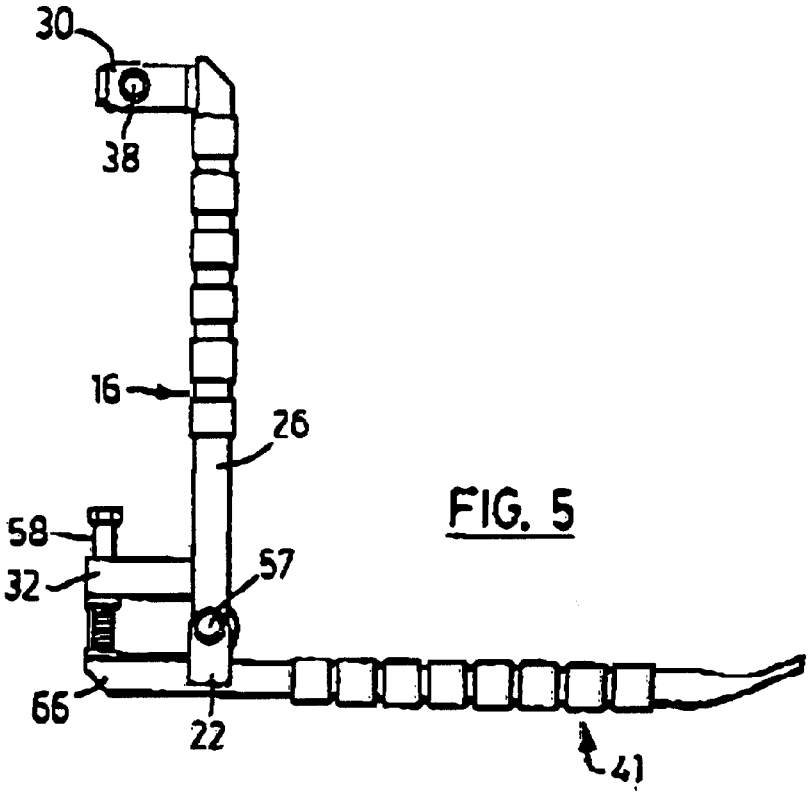
FIG. 5 is a side elevation of one side of the footrest.
Figure 6:
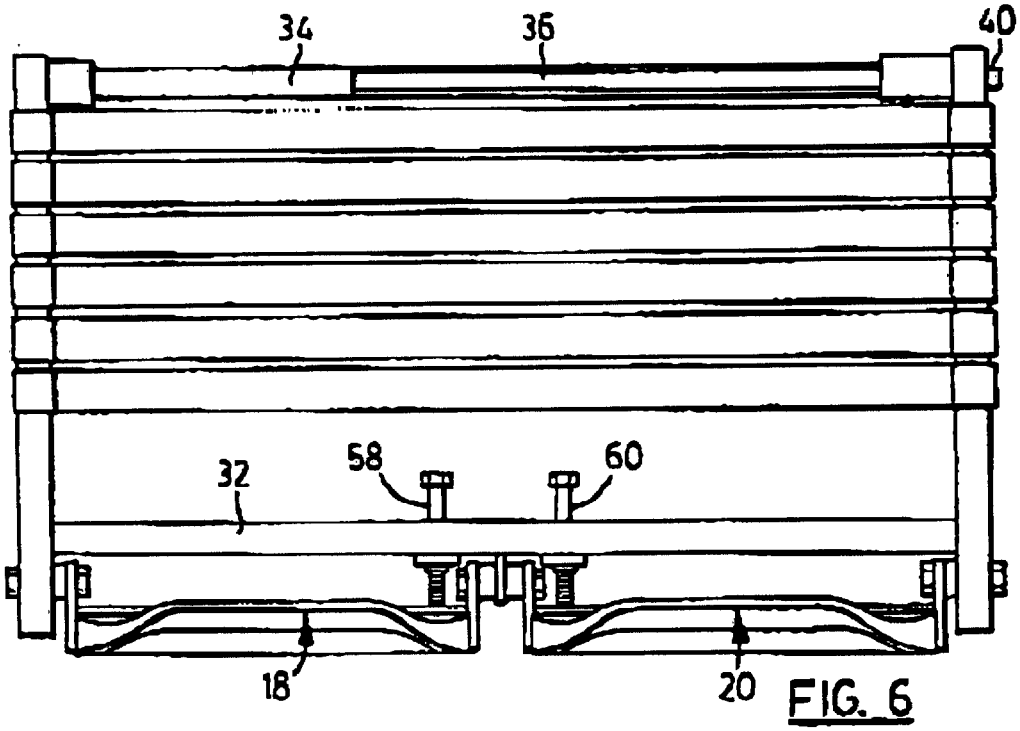
FIG. 6 is a front elevation view of the footrest.
Figure 7:
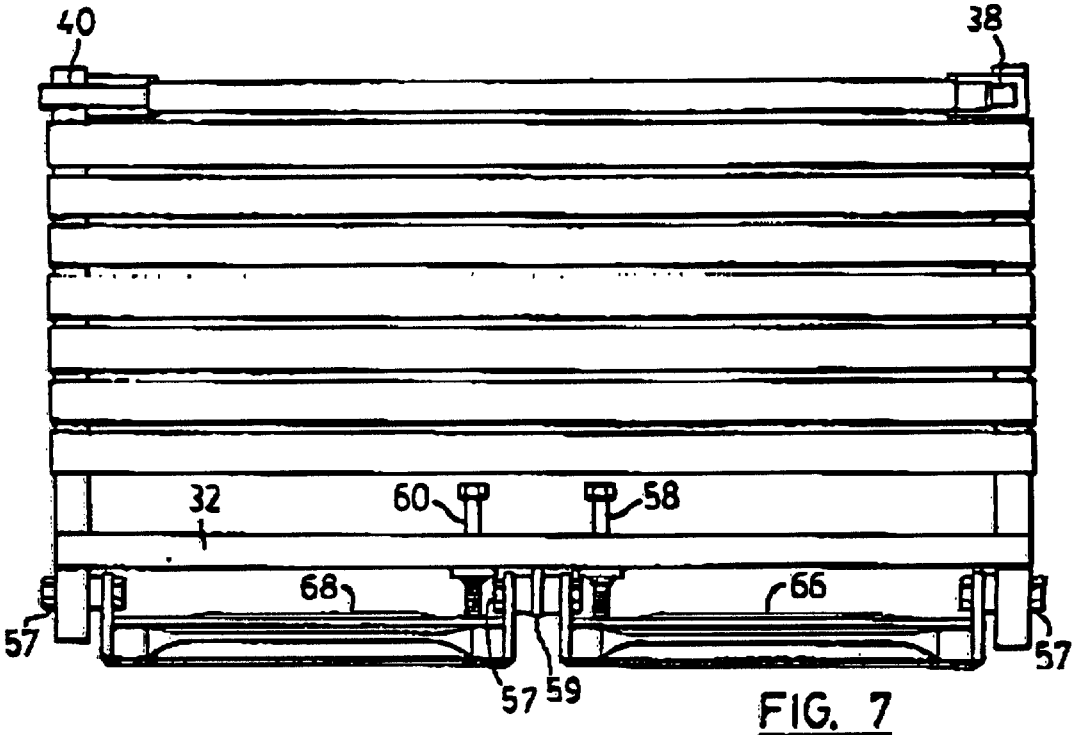
FIG. 7 is a back elevation view of the foot rest.
Figure 8:
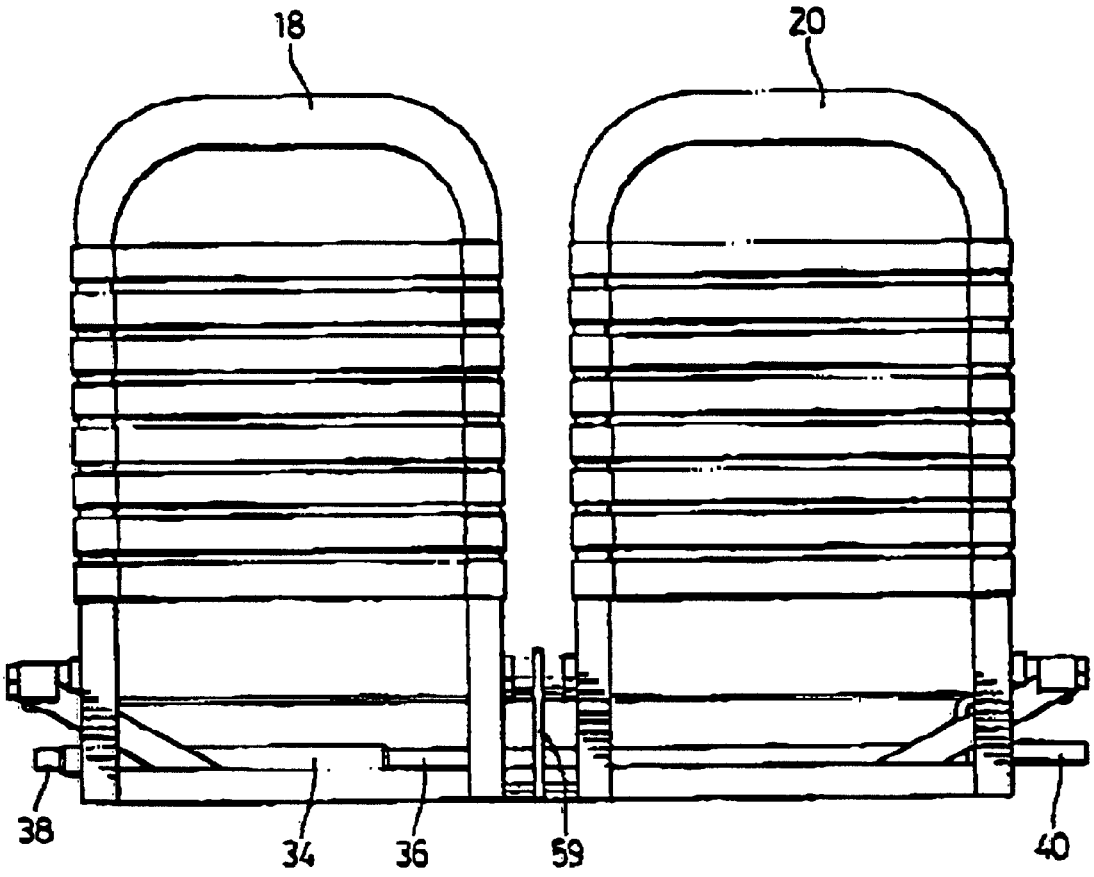
FIG. 8 is a view from underneath the foot rest.

Referring to FIGS. 1 and 3, the footrest 10 of the present invention, adapted for use with a chair, and preferably a health care chair 12, is disposed below and at the front of the seat 14 of such chair. The footrest 10 comprises a substantially vertical, singular leg support member 16, disposed at substantially right angles to the chair seat 14, for supporting the rear of a person's lower legs, and two independent footplate members 18, 20, for supporting a person's feet, when such person is sitting in the chair. The footplate members 18, 20 are each, independently from the other, pivotally coupled to and depending from the leg support member 16 at a lower end 22, 23 thereof for achieving various fixed positions of tilt relative thereto.

In one embodiment of the present invention, the leg support member 16, illustrated in more detail in FIG. 3, of the present invention forms the lower portion of the leg rest 24 of the health care chair 12. The leg support member 16 includes two spaced apart substantially vertical tubular frame members 26, 28, joined at the top by rearwardly extending bracket 30 and at the bottom by rearwardly arcuate, tubular frame member 32, with a plurality of traversing strap members 31 disposed therebetween to form a means for supporting the lower leg of a person sitting in the health care chair 12.

Figure 2:
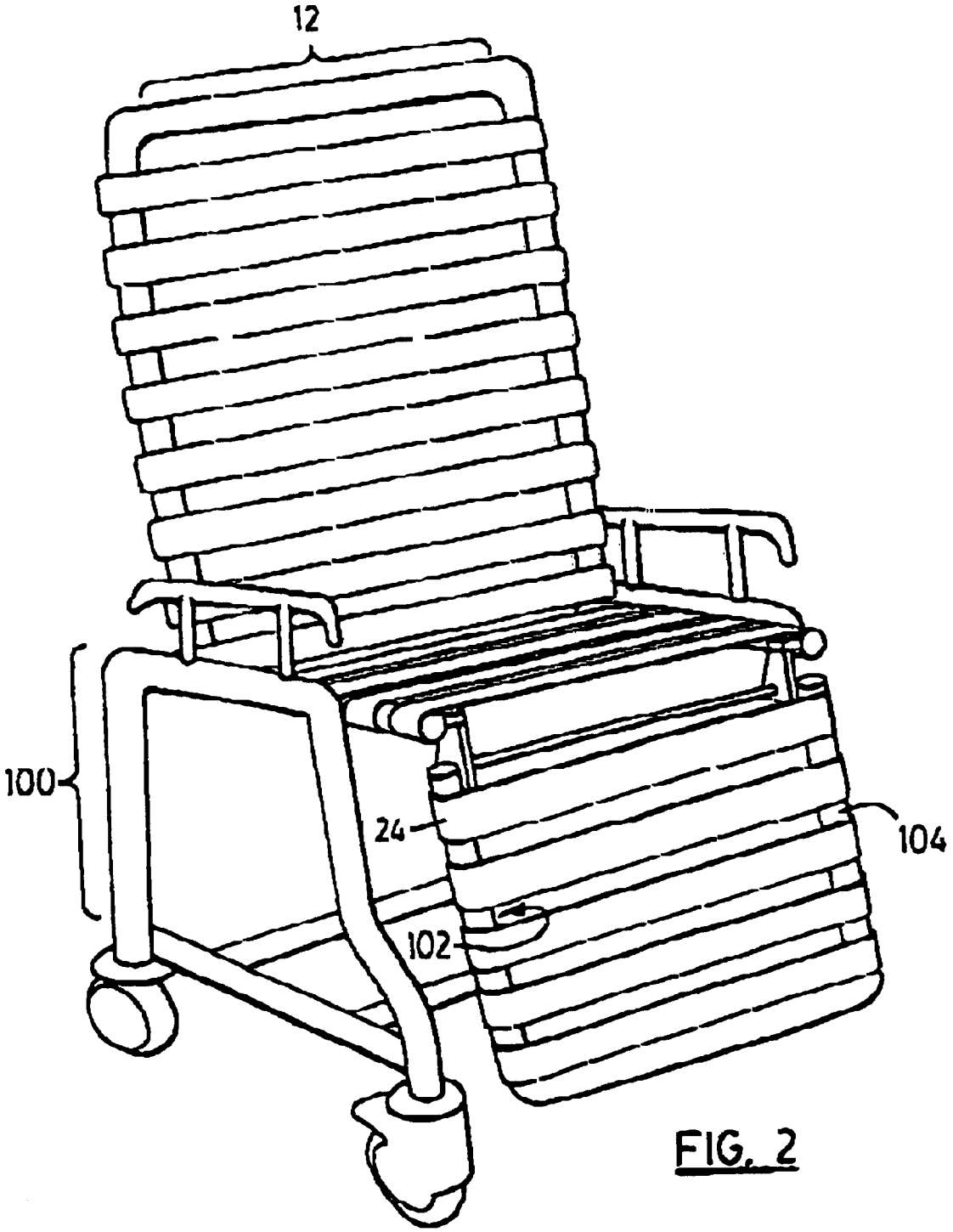
FIG. 2 is a top perspective of the health care chair of FIG. 1, shown without the footrest for clarity of illustration.

Referring to FIGS. 1, 2 and 3, the footrest 10 is coupled to the upper leg rest 24 by coupling means 34 which includes a longitudinally spring loaded attachment bar 36 with opposite ends 38, 40 which extend through apertures 37, 39 in the bracket 30 and is received by mating apertures 102, 104 in the chair 12. In another embodiment, means can be provided for vertical adjustment of the footrest 10 to suit the paient's leg length.

Although the leg support member 16 in FIG. 2 is adapted to form the lower portion of the leg rest 24, the length of the leg support member 16 may be extended such that the leg support member 16 comprises the entire leg rest 24 for a health care chair 12, or forms part of the frame 100 of the health care chair 12. In this respect, the coupling means 34 would be correspondingly adapted for coupling of the footrest 10 to the health care chair 12.

Referring to FIGS. 2, 3, 4, 5, 6, 7 and 8, two footplate members 18, 20 are provided, each of which comprises substantially u-shaped frame members 41, 43, disposed side by side, with parallel side members 46, 48 and 50, 52 with respective web members 47, 49 and a plurality of traversing strap members 54 disposed therebetween to form planar foot support means. The footplate members 18, 20 are independently pivotally coupled to the leg support member 16 at the bottom thereof along the same axis 55 by bolts 57 passing through the lower ends of frame members 26, 28 and through central bracket 59 to allow each such footplate member 18, 20 to be pivotable about the leg support member 16 independently of the other. Accordingly, each footplate member is capable of being swung upwardly and downwardly, independent of the other. This facilitates movement in and out of the chair, especially when assistance from a caregiver is necessary.

By way of example, when a person is being assisted into the chair, both footplate members 18, 20 are swung upwardly so as not to impede access to the chair. Once the person is seated in the chair, the footplate members 18, 20 must be swung downwardly into a desired foot support position, one of which is illustrated in FIG. 1, if they are to provide support to the person's feet while he or she is sitting in the chair. In order to facilitate this, the person's legs must be physically moved out of the way while the footplate members 18, 20 are being swung down. If the two footplate members 18, 20 were integral with each other (ie. a single footplate), the person's legs would have to be either vertically lifted or spread about either side of the footrest 10 to avoid downward movement of the footplate members 18, 20 into the foot support position. However, because each of the footplate members 18, 20 is independently coupled to the leg support member 16, each of tho footplate members 18, 20 may be swung downwardly independently from the other, which effectively reduces the degree by which the person's legs must be manipulated by the caregiver to avoid the descending footplate members 18, 20. This is because, as the first of the two foot footplate members 18, 20 is swung downwardly, both the person's legs are only moved laterally to one side, which is relatively less cumbersome than the above-described situation with a single footplate. Once the first footplate 18 or 20 is down, both legs and feet may be supported on the footrest 10 while the second footplate 18 or 20 is brought down, without further burdening the person in the chair or the caregiver.

Tilt position of the footplates 18, 20 is fixed angularly relative to the leg support member 16 by adjustable stop means 56. In one embodiment, and as illustrated most clearly in FIG. 3, the adjustable stop means 56 includes extendible stop members 58, 60 whose lower ends 62, 64 are disposed rearwardly of the axis 55 and are adapted for biasing against the rear 66, 68 of each of the footplate members 18, 20. The stop members 58, 60 shown are threaded bolts, received by corresponding threaded mating apertures 70, 72 within the horizontal leg support frame member 32. Tilt of either of the footplate members 18, 20 may be controlled by threading bolts 56, 58 upwardly or downwardly to adjust the vertical position of the lower ends 62, 64 of the stop member 68, 60. It is understood that adjustable stop means 56 is not limited to that illustrated in the Figures, and could include various clamping devices adapted for securing the footplate member 18, 20 to the leg support member 10 at various tilt positions relative thereto.

It will be understood, of course, that modifications can be made in the embodiments of the invention illustrated and described herein without departing from the scope and purview of the invention as defined by the appended claims.

What is claimed is:

1. A footrest, adapted for use with a health care chair, said footrest comprising:

a frame for attachment to a chair, said frame comprising first and second vertical members and a rearward arcuate member extending between said first and second vertical members, said rearward arcuate member having threaded apertures;

first and second footplate members independently pivotally coupled at exterior edges thereof to said first and second vertical members respectively alone a common axis for pivotal movement from a substantially horizontal position to a substantially vertical position, said first and second footplate members extending rearwardly of said common axis;

a central bracket extending from said rearward arcuate member and pivotally connected to each of said first and second footplate members at interior edges thereof along said common axis for providing additional support to said first and second footplate members; and vertically adjustable threaded stop members received by said threaded apertures, lower ends of said stop members pressing against each of said first and second footplate members for maintaining each of said first and second footplate members at a fixed position of tilt.

2. A footrest adapted for use with a health care chair, said footrest comprising:

a frame for attachment to a chair, said frame comprising first and second vertical members and a rearward arcuate member extending between said first and second vertical members, said rearward arcuate member having first and second threaded apertures;

first and second footplate members independently pivotally coupled at exterior edges thereof to said first and second vertical members respectively along a common axis for pivotal movement from a substantially horizontal position to a substantially vertical position, said first and second footplate members extending rearwardly of said common axis; and vertically adjustable threaded stop members received by said threaded apertures, lower ends of said stop members pressing against each of said first and second footplate members for maintaining each of said first and second footplate members at a fixed position of tilt.

3. The footrest of claim 2 further comprising a central bracket extending from said rearward arcuate member and pivotally connected to each of said first and second footplate members along said common axis for providing additional support thereto.

4. A footrest adapted for use with a health care chair, said footrest comprising:

a frame for attachment to a chair;

first and second footplate members, wherein each of the footplate members independently pivotally coupled to the frame along a common axis for pivotal movement from a substantially horizontal position to a substantially vertical position; and first and second vertically adjustable stop members associated with the first and second footplate members respectively, each of the stop members having a lower end, the lower ends of the stop members pressing against atop surface of the footplate members and thereby maintaining the footplate members at fixed positions of tilt.

5. The footrest as claimed in claim 4 wherein each of the lower ends of the stop members is characterized by a vertical position whereby such vertical position fixes the position of tilt of the associated footplate member.

6. The footrest as claimed in claim 5 wherein each of the footplate members extend rearwardly of the common axis and wherein each of the lower ends presses against a portion of the associated footplate member and such portion is located rearward of the common axis.

7. The footrest as claimed in claim 6 wherein the stop members are threaded, and wherein the frame comprises a horizontal frame member having threaded apertures for receiving the stop members.

8. The footrest as claimed in claim 7 wherein the frame further comprises first and second vertical frame members, the first and second footplate members being pivotally coupled to the first and second vertical frame members respectively along the common axis for pivotal movement from a substantially horizontal position to a substantially vertical position, the horizontal frame member being disposed between the first and second vertical frame members and rearward of the common axis.

* * * * *

UNITED STATES PATENT AND TRADEMARK OFFICE

CERTIFICATE OF CORRECTION

PATENT NO. : 6,076,893
DATED : June 20, 2000
INVENTOR(S) : Ian Brotherston

It is certified that error appears in the above-identified patent and that said Letters Patent is hereby corrected as shown below:

Item [54] "FLIPDOWN FOOTREST INVENTION" should read -- FLIPDOWN FOOTREST --.
Please insert after item [22] Filed: -- Related U.S. Application Data --.
Please insert after Related U.S. Application Data -- item [60] Provisional Application No. 60/045,766, May 6, 1997 --.

Claim 1, column 4,
Line 35, "A footrest, adapted" should read -- A footrest adapted --.
Line 44, "respectively alone a common" should read -- respectively along a common --.

Claim 4, column 6,
Line 1, "against atop surface" should read -- against a top surface --.

Signed and Sealed this

Eighteenth Day of September, 2001

*Attest:*

Nicholas P. Godici

*Attesting Officer*

NICHOLAS P. GODICI
*Acting Director of the United States Patent and Trademark Office*